10/22/85 OR 4,548,251

United States Patent [19]

Lange

[11] Patent Number: 4,548,251

[45] Date of Patent: Oct. 22, 1985

[54] METHOD OF PRODUCING SEWING MACHINE NEEDLES

[75] Inventor: Horst Lange, Aachen, Fed. Rep. of Germany

[73] Assignee: Rhein-Nadel Maschinennadel GmbH, Aachen, Fed. Rep. of Germany

[21] Appl. No.: 528,699

[22] Filed: Sep. 1, 1983

[30] Foreign Application Priority Data

Sep. 23, 1982 [DE] Fed. Rep. of Germany ..... 3235153

[51] Int. Cl.[4] ..... B21G 1/04

[52] U.S. Cl. ..... 163/5

[58] Field of Search ..... 163/1, 4, 5

[56] References Cited

U.S. PATENT DOCUMENTS

| | | | |
|---|---|---|---|
| 1,259,982 | 3/1918 | Heusch . | |
| 4,037,641 | 7/1977 | Zocher | 163/5 |
| 4,044,814 | 8/1977 | Zocher | 163/5 |

FOREIGN PATENT DOCUMENTS

| | | | |
|---|---|---|---|
| 699244 | 11/1940 | Fed. Rep. of Germany | 163/5 |
| 1952152 | 6/1971 | Fed. Rep. of Germany . | |
| 2947806 | 7/1981 | Fed. Rep. of Germany | 163/5 |
| 3207167 | 10/1982 | Fed. Rep. of Germany . | |
| 302627 | 1/1955 | Switzerland . | |
| 16030 | of 1913 | United Kingdom | 163/5 |
| 1136020 | 12/1968 | United Kingdom . | |

*Primary Examiner*—Mark Rosenbaum

*Attorney, Agent, or Firm*—Martin A. Farber

[57] ABSTRACT

A method of manufacturing sewing machine needles, each having a needle shank with a point, a needle butt and a section between the shank and the butt, from a cylindrical length of wire constituting two coaxial connected needle blanks being of one-piece which are worked simultaneously such that two of the needles are formed therefrom arranged with points of the two needles facing each other.

15 Claims, 26 Drawing Figures

METHOD OF PRODUCING SEWING MACHINE NEEDLES

This invention relates to a method of producing sewing machine needles from a cylindrical length of wire by compression molding. Particularly the method starts from a diameter of the length of wire corresponding to the thickness of the needle butt, the length of wire being reduced approximately to the final cross-sectional size over at least the length of the needle shank and of a section between the needle shank and butt, and, furthermore, in the region of the needle shank, the thread grooves are pressed in from the curved outer surfaces of the length of wire, the reduction in cross section being effected by pressing opposite portions of the wire material so as to form laterally projecting flat fins, leaving therebetween, the transversely convexly curved outer surfaces which have the final diameter, the flat fins being removed in a subsequent step, two coaxial needle blanks being worked simultaneously with their points facing each other.

This compression molding from a solid blank represents a clear advance in manufacture as compared with the conventional, frequently time-consuming method of reduction by a rotating press, consisting in particular in the large number of needles which can be produced per unit time.

The object of the present invention is to further simplify the manufacture and, in particular, to reduce or eliminate as far as possible the proportion of the flat fin material which must be removed.

This object is achieved in the manner that the region extending over the length of the needle shanks is shaped, before production of the thread grooves, respectively, extending from the section between the shank and butt of one of the needle blanks up to that of the opposite needle blank, into a central portion of smaller cross-section of the length of wire. While completely or partially retaining the introductorily set forth method, due to the additional step, the excess material which is be finally separated from the double-needle blank is reduced or eliminated and the manufacturing is thus further simplified. It is no longer necessary to start from a soft base material. The possible displacement of the excess material of the blank into opposite laterally projecting flat fins now takes place in a manner which is even gentler to the structure, from a portion which has already been reduced in cross section or only in the region of the facing point during their manufacture. The pressing tools can be made correspondingly finer. The reduction in cross section can be effected rapidly and without problems either without cutting or else by a cutting operation, particularly since the length of wire is adapted to the length of two needle blanks, which favors control of the blank, for instance in a follow-on pressing tool. One possibility for a reduction of the cross-section by cutting consists in grinding the length of wire in the central region between the butts. Another method is that of a centerless turning or milling. The shaping of the blank without cutting consists of a rolling, possibly cold-rolling, effected in separate steps. This manner of shaping furthermore has the advantage of a saving of material due to the consequent lengthening of a shorter blank to twice the needle length.

Further advantages and details of the method are described in further detail below with reference to preferred examples of the method shown in the drawing, in which:

FIG. 5 shows the blank of FIG. 3 after the;

Figure 11:
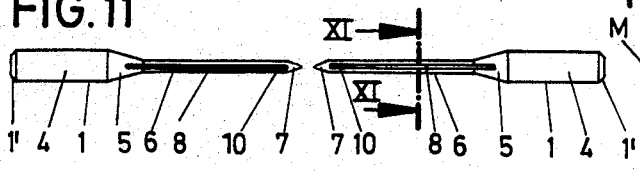
FIG. 11 is a view corresponding to FIG. 10, and shows the double-needle blank after the cutting and separating.
Figure 11A:
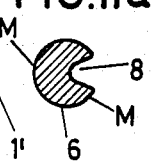
Figure 12:
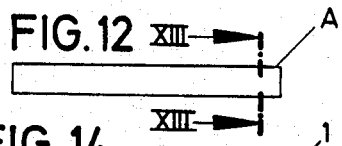
Figure 13:
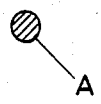
Figure 14:
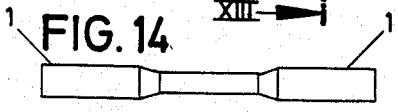
Figure 15:
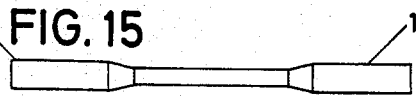
Figure 16:
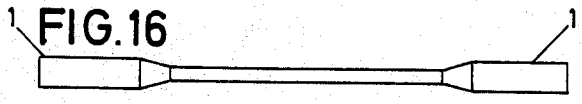
Figure 17:
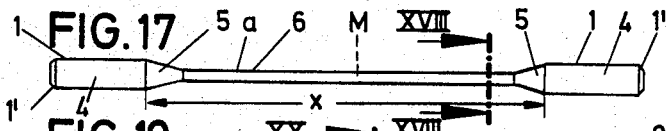
Figure 18:
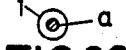
Figure 19:
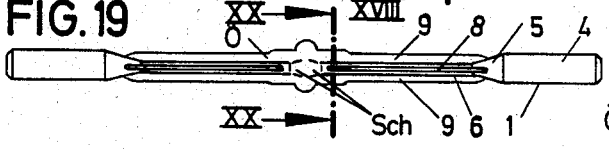
Figure 20:
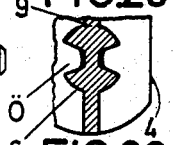
Figure 21:
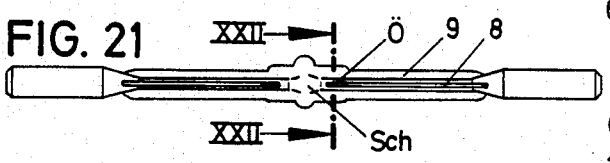
Figure 22:
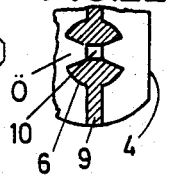
Figure 23:
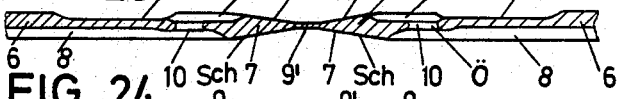
Figure 24:
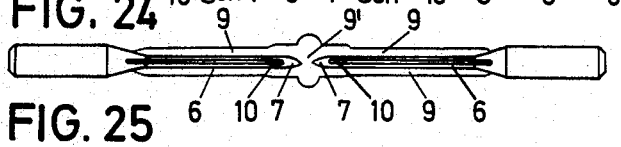
Figure 25:
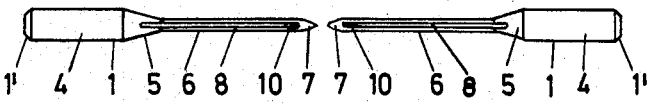

FIG. 11*a* is a section along the line XIa—XIa of FIG. 11, on a larger scale;

FIG. 12 shows the length of wire forming a shorter starting material, namely of a volume of material which corresponds to the length of two needles, seen in side view on an enlarged scale;

FIG. 13 is a section along the line XIII—XIII of FIG. 12;

FIGS. 14–17 show intermediate shapes of the double-needle blank produced by shaping without cutting, with step-wise reduction of the cross-section of its central section, seen in side view on an enlarged scale;

FIG. 18 is a section along the line XVIII—XVIII of FIG. 17;

FIG. 19 is a view corresponding to FIG. 17, and shows this blank after the compression molding;

FIG. 20 is a section along the line XX—XX of FIG. 19, on a larger scale;

FIG. 21 is a showing corresponding to FIG. 19, but after punching of the needle eyes;

FIG. 22 is a section along the line XXII—XXII of FIG. 21, again on a larger scale;

FIG. 23 is a longitudinal section in the region of the facing points of the double-needle blank, on a larger scale;

FIG. 24 is a view corresponding to FIG. 21, and shows the so-called pointing of the blank; and FIG. 25 is a view corresponding to FIG. 24, and shows the double-needle blank after the cutting.

The blank for the manufacture of sewing machine needles is formed by a cut length A of wire. It has a circular cross section. Its diameter corresponds esentially to that of the cylindrical butt 1 of the needle.

Figure 1:
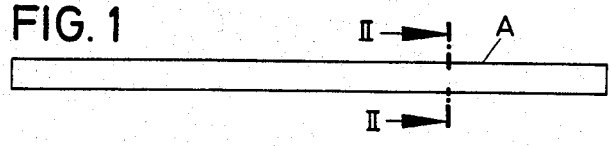
FIG. 1 shows a piece of wire having a length of two needles which forms the starting material, seen in side view on an enlarged scale.
Figure 2:
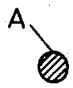
FIG. 2 is a section along the line II—II of FIG. 1.

The total length of the cut length of wire A corresponds to the material required for the simultaneous production of two sewing machine needles, thus constituting a double-needle blank. In the case of shaping without cutting (FIG. 12 et seq.) one starts from a smaller total length than in the case of a cutting operation. This can also be noted visually by a comparison of FIGS. 1 and 12.

Before pressing thread grooves 8 into the blank at times with the formation of lateral flat fins 9, the central portion a of the double-needle blank is reduced in cross section over a portion x which extends from a section 5 of the one needle blank up to the section 5 of the opposite needle blank. This portion a of smaller cross section in this manner is already brought approximately to the cross sectional dimension of a needle shank 6 to be formed and is about one-third of the diameter of a butt 1 of the needles to be formed. At the same time as this, the butts 1 which are left in the region of the ends of the length of wire A are chamfered at their ends at 1'. The central section portion a extends coaxially to the butt, but may also be eccentric thereto.

Upon the reduction in cross-section by cutting in accordance with a first example of the method e.g. FIGS. 1–11, the blank in all the machining phases retains substantially a length which corresponds to that of the starting material and therefore the length of wire A. The transport means of a follow-on tool (not shown) can therefore operate continuously on corresponding linear gripping planes located further to the outside, namely grasping the terminal butts 1.

In a second example of the method of the present invention FIGS. 12–25 a piston (not shown) changes its position in space as a result of the stepwise reduction in cross section, for instance by rolling down the central portion of the blank. Here a useful primary advantage is a saving of material.

Figure 3:
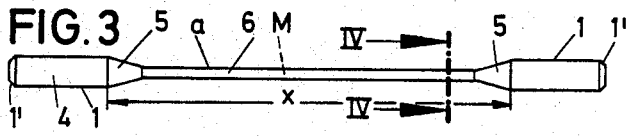
FIG. 3 shows the length of wire with clear indication of a central section of smaller cross section double-needle blank.
Figure 4:
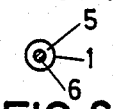
FIG. 4 is a section along the line IV—IV of FIG. 3.
Figure 5:
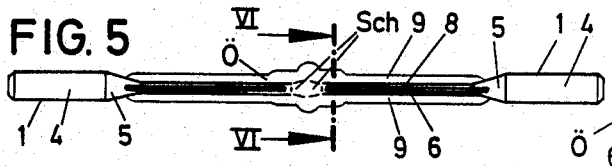
Figure 6:
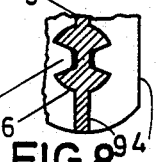
FIG. 6 is a section along the line VI—VI of FIG. 5, on an even larger scale.
Figure 7:
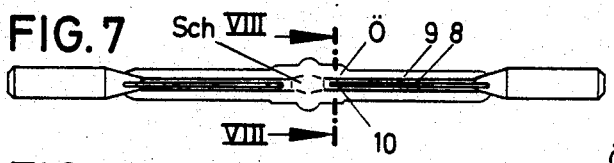
FIG. 7 is a view corresponding to FIG. 5, but after the punching of the needle eyes.
Figure 8:
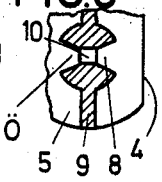
FIG. 8 is a section along the line VII—VII of FIG. 7, again on an enlarged scale.
Figure 9:
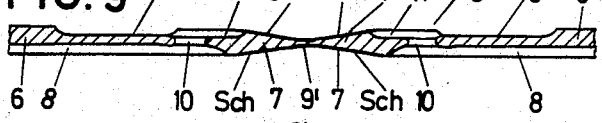
FIG. 9 is a longitudinal section of FIG. 7 in the region of the facing points of the double-needle blank, shown enlarged.
Figure 10:
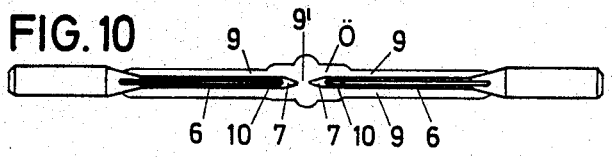
FIG. 10 is a view corresponding to FIG. 7, and shows the so-called pointing of the blank.

Otherwise, the same intermediate product is obtained as shown in FIG. 17 as in FIG. 3.

From here the further phases of manufacture of the two embodiments are the same and both will be described together.

The intermediate product in accordance with these figures is now fed to the first station of a compression molding press tool, the upper and lower dies of which (not shown) are so equipped that aside from the producing of the hole in the eye portion "Ö," the final shape of the needle is produced by displacement of material by one stroke of the press. The blank thereupon is formed with a customary flattening 4 in the region of its butt 1 and furthermore with the final shape of the frustoconical section 5 which adjoins it. The latter extends into the needle shank 6, which is also formed so as to terminate in a partially shaped needle point 7.

The needle shank 6 is thus formed with the cross-sectional shape of a V profile (see FIG. 11*a*) as a result of the simultaneous impressing of, in each case, one needle groove 8 which extends from the section 5 up into the region of the point.

In the vicinity of the eye Ö a so-called fillet 6' is also already pressed in, extending on the side of the needle shank opposite the needle groove 8. The manufacturing operation for this includes also the simultaneous formation of a so-called short groove 17 adjacent the eye. The eye itself is, however, not yet completely formed with a hole. It was only preembossed and denoted in the drawing with a needle eye reference numeral 10 for easy understanding in FIGS. 5 and 19. The depth of the prestampings produced on both sides of the body of the needle which are aligned with the course of the grooves 8, 17 can be noted from FIGS. 6 and 20.

Due to the displacement of the material upon the formation of the grooves 8, 17 and particularly the shaping of the point 7, and the formation of the fillet 6, material of the blank in partially different quantity passes through a tool slot on both sides left between the upper and lower dies (shown in exaggerated manner). This also explains the different edge shape of the material 9 which is displaced to form the flat fins 9, particularly the greater width of the fin in the region of the point. The flat fins can possibly even be limited entirely to this (double) point 7, 7 region.

As a result of the preliminary reduction operation of the shank-forming portion of the blank, less material need be displaced than upon stamping from a solid blank. It is therefore possible to start from a relatively harder base material.

At the next processing station the stamping through of the needle eyes 10 takes place. In this connection the facing points 7, the shape of which is already indicated, are still present as a bridge of material as a result of the fins, although this region has also been thinned by the preliminary pressing operation. The previous point-forming portion of the closed-die pressing consists in flattening the point region, starting from the general diameter of the shank, into the shape of a knife. There is thus produced a bevel Sch forming a wedge shape which converges in the shape of a roof on both sides to the level of the remaining intermediate section 9' of the flat fins 9, which in this connection is itself possibly also further flattened.

At the same time as the stamping of the needle eyes or else at an additional station of the follow-on tool the so-called dimpling I and II are effected. There is meant by this the rounding of the upper and lower edges of the needle eye. For this purpose the needle blank can be turned 180° around its axis. The turned position can be noted from FIGS. 9 and 23.

In another station or at the same time the pointing of the needle blank can be carried out. By this the needle point 7 is practically given its final shape, as can be noted from FIG. 10. With due consideration of the knife-shaped bevel Sch which converges towards the forward region of the point and is already present, there is now effected also a two-sided beveling in the vertical so that as a whole an approximately pyramidal point body is produced. The last-mentioned shaping can, however, also take place at the same time as the cutting and separating of the double-needle body. The two needle blanks are thereupon introduced into further treatment phases, i.e. final pointing, heat treatment, polishing, electroplating, and finally the final inspection.

I claim:

1. A method of manufacturing sewing machine needles, each having a needle shank with a point, a needle butt and a section between said shank and said butt, from a cylindrical length of wire constituting two coaxial connected needle blanks being of one-piece which are worked simultaneously such that two of said needles are formed therefrom arranged with points of said two needles facing each other, comprising the steps of selecting an initial diameter of the length of wire constituting said two coaxial connected needle blanks corresponding to the thickness of the needle butts, respectively of the needles to be manufactured, working said two coaxial connected needle blanks so as to simultaneously form said two needles therefrom, comprising the steps of first shaping a central portion of said two blanks, said central portion extending over the length of the needle shanks of said two needles to be manufactured, respectively, from said section of one of said two needles to be manufactured in one of said two needle blanks to said section of the other of said two needles to be manufactured in the other of said two needle blanks, said first shaping of said central portion reducing the diameter of said central portion to a cross section of a smaller diameter than said initial diameter, said first shaping simultaneously initially forming said sections, secondly further reducing by compression molding said central portion approximately to a final cross-sectional shape of said needle shanks over at least the length of said needle shanks and said sections while pressing thread grooves in the region of the needle shanks from curved outer surfaces of said length of said wire while simultaneously forming the points of said two needles facing each other and relatively small flat fins along said central portion at least at said points and between said points.

2. The method of claim 1, wherein said compression molding step of reducing said central portion comprises pressing said central portion from opposite sides so as to form said relatively small flat fins laterally projecting from said central portion, removing said flat fins.

3. The method according to claim 2, further comprising the step of pointing said points of said two needles with said fins therebetween.

4. The method according to claim 1, wherein said first shaping produces said smaller diameter substantially equal to said final cross-sectional dimension of said needle shanks.

5. The method according to claim 1, wherein said flat fins extend completely along said central portion and between said points including at least portions of said sections.

6. The method according to claim 1, further comprising the step of cutting and separation of said two blanks between said points of said two needles.

7. The method according to claim 1, wherein said first shaping is performed by cutting.

8. The method according to claim 1, wherein said first shaping is performed by grinding.

9. The method according to claim 1, wherein said first shaping is performed by centerless turning.

10. The method according to claim 1, wherein said first shaping is performed by milling.

11. The method according to claim 1, wherein said first shaping is performed by rolling.

12. The method according to claim 11, wherein said rolling is effected in separate steps.

13. The method according to claim 11, wherein said rolling lengthens said two blanks to substantially twice the length.

14. The method according to claim 1, wherein said first shaping is performed by cold rolling.

15. The method according to claim 1, wherein said flat fins extend completely along said central portion and between said points.

* * * * *